United States Patent [19]

Gregory

[11] 4,342,216

[45] Aug. 3, 1982

[54] LIMITED STROKE FORCE DELIVERING TOOL

[76] Inventor: Jack T. Gregory, 1322 Ross St., Petaluma, Calif. 94952

[21] Appl. No.: 205,427

[22] Filed: Nov. 10, 1980

[51] Int. Cl.[3] ..... B21J 9/12; B21D 7/06

[52] U.S. Cl. ..... 72/453.16; 60/479; 72/410

[58] Field of Search ..... 72/453.01, 453.15, 453.16, 72/453.19, 410, 409, 416; 81/301; 60/479, 477

[56] References Cited

U.S. PATENT DOCUMENTS

| | | | |
|---|---|---|---|
| 2,696,850 | 12/1954 | Peterson | 81/301 |
| 3,740,952 | 6/1973 | Fujii | 60/477 |
| 4,031,619 | 6/1977 | Gregory | 81/301 |
| 4,086,802 | 5/1978 | Ewig | 72/391 |
| 4,132,107 | 1/1979 | Suganuma | 72/453.16 |
| 4,248,077 | 2/1981 | Gregory | 72/391 |
| 4,263,801 | 4/1981 | Gregory | 72/391 |

*Primary Examiner*—Gene Crosby
*Attorney, Agent, or Firm*—Melvin R. Stidham

[57] ABSTRACT

A hydraulic force-delivering hand tool, such as a cable crimper, comprising a body with a large axial bore at one end forming a cylinder. A piston is slidable in the cylinder and has a nodular mass at the outer end to drive against a member to be crimped. A plunger pumps a quantity of fluid past a transfer one-way check valve and into the cylinder, to drive the piston forward a small increment each stroke. When the piston passes through its full predetermined stroke to effect a complete crimp, interengaging means on the transfer check valve and on the piston, lift the transfer check valve from its seat to prevent further travel and to relieve fluid back to the transfer chamber. A button may then be pressed to unseat a relief check valve, to relieve the cylinder to the reservoir.

12 Claims, 5 Drawing Figures

LIMITED STROKE FORCE DELIVERING TOOL

BACKGROUND OF THE INVENTION

Crimping tools are widely employed in a number of different applications, such as in connecting electrical cables using tubular connectors. The ends of a pair of electrical cables are inserted into a deformable tubular connector, and it is then crimped sufficiently to grip the cables firmly. Crimpers presently employed for such work are usually heavy, cumbersome mechanical devices which are extremely difficult to manipulate, particularly in precarious positions in which linemen often find themselves. Hydraulic tools could deliver the necessary force for crimping, but such generally require pumps, hoses and the like which are impractical for use in the field.

OBJECTS OF THE INVENTION

It is an object of this invention to provide an easily handled crimping tool which is capable of delivering sufficient crimping forces.

It is a further object of this invention to provide a readily manipulable hydraulic crimping tool.

It is a further object of this invention to provide a hydraulic crimping tool which will produce an adequate, but not excessive crimp.

Other objects and advantages of this invention will become apparent from the description to follow, particularly when read in conjunction with the accompanying drawings.

SUMMARY OF THE INVENTION

In carrying out this invention, I provide a generally cylindrical body having a large cylindrical bore at one end accommodating a piston, and a smaller bore from the other end, accommodating a plunger pump. A fluid reservoir completely surrounds the body, and an inlet check valve enables flow in one direction only from the reservoir to a transfer chamber within the body. The transfer chamber is in communication with the cylinder through a transfer check valve that normally prevents return flow to the transfer chamber. In operation, when the plunger is withdrawn, the inlet check valve is unseated to take in a charge of fluid. Then, when the plunger is extended it forces the fluid into the cylinder past the transfer check valve, to drive the piston forward through an increment of movement. The transfer check valve is carried on the end of a small piston which is slidable in a small bore extending into the main piston. When the main piston travels through a predetermined stroke, internal and external shoulders in the bore and on the small piston, respectively, engage so that any further slight movement of the main piston lifts the transfer check valve from its seat to prevent such movement and to relieve the fluid in the main cylinder back to the transfer chamber. This lessening of pressure is sufficient to enable the operator to press a button which carries a push rod to force the inlet check valve from its seat and allow complete relieving past it, back to the reservoir. A spring then returns the main piston to the start of its stroke.

DESCRIPTION OF A PREFERRED EMBODIMENT

Figure 1:
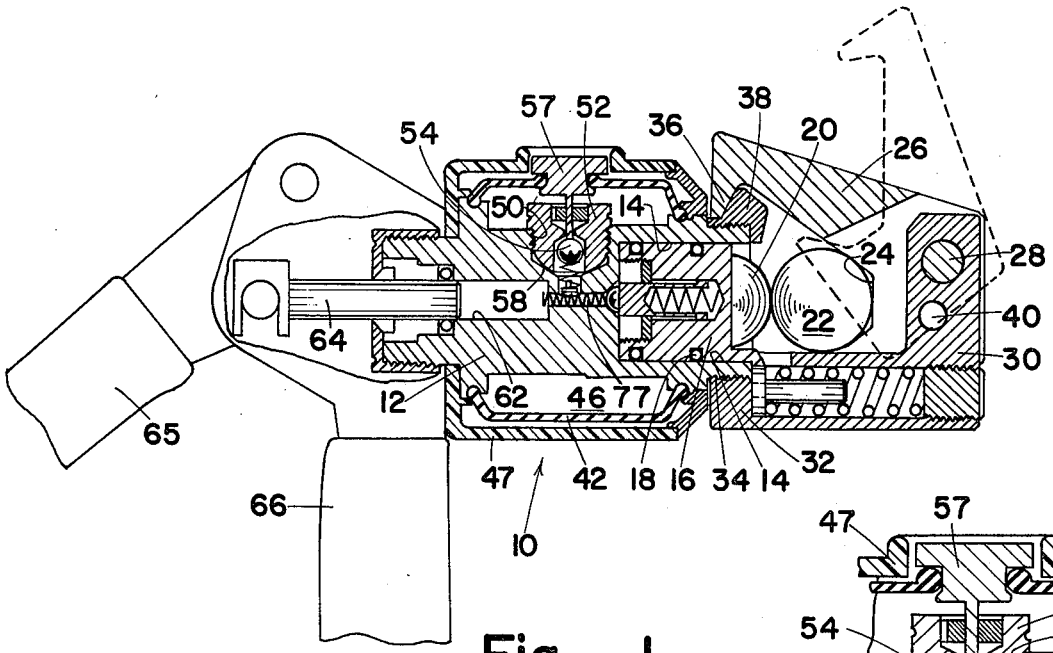
FIG. 1 is a side view partially broken away of a crimping tool embodying features of this invention.

The Embodiment of FIGS. 1 to 4

Referring now to the drawings with greater particularity, the crimping tool 10 of this invention comprises a body 12 of steel or the like having a cylindrical bore 14 at one end forming a hydraulic cylinder. A piston, provided with suitable seals 18, is slidable in the cylinder 14 and has a nodular mass 20 at its outer end to engage a work piece 22 such as a tubular connector for electrical cables, which are received in each end and the assembly crimped together to lock the cables in place.

During crimping, the work piece 22 is seated and pressed against a saddle or anvil 24 on the pivoted jaw 26 of a hinged clamp. The jaw 26 is pivoted at 28 to a stationary hinge component 30. The stationary component 30 is on a collar 32 which is threaded at 34 onto the end of the body 12. When the jaws 26, 30 are closed, a pair of lips 36 and 38 on the movable jaw 26 and the collar, respectively, slidable engage and, initially, they may be retained in this position by a spring detent 40. However, once pressure is applied to the work piece, as will hereinafter be described, the force against the work piece, and hence the anvil 24, is offset from the pivot pin 28, as shown by the arrow F (FIG. 3) so that the moment of force M is in a counter-clockwise direction in the drawings, bringing the tapered lips 36 and 38 into firmer wedging engagement.

A flexible sleeve 42 of rubber or the like, completely surrounds the body 12 and O-ring type seals 44 at the ends thereof are gripped to form a fluid tight reservoir 46 completely surrounding the body 12. The sleeve is protected by a shield 47 of a relatively rigid plastic. A lateral bore 48 into the valve body 12 is tapped at 50 to threadedly receive a valve assembly 52, which carries a spring-biased inlet check valve 54, which normally enables flow from the reservoir 46 to a transfer chamber 60, but prevents return flow to the reservoir. A conical surface at the bottom of the bore 48 is sealed by a spherical surface 58 on the valve assembly 52.

In communication with the transfer chamber 60 is a longitudinal bore 62, which accommodates a plunger pump 64 pivoted to a hand operated lever 65. Hence, the levers 65 and 66 may be sequentially squeezed together and released to reciprocate the plunger 64. A transfer flow passage 69 enables flow into the cylinder 14 past a transfer check valve 70 when driven by the plunger 64 but, because of the inlet check valve 54 flow to the surrounding reservoir 46 is blocked. However, as will be described if pressure is not excessive, the inlet check valve 56 can be unseated by pressing the button 57 at the top of the reservoir to cause the pin 59 to dislodge the ball 54.

The transfer check valve 70 is carried on a small piston 76 having a flange or shoulder 78 on the trailing end thereof which slides in a small bore 80 extending into the piston 16. A collar 82 is threaded into a tapped counter bore in the piston 16 at a precise distance from the initial position of the smaller piston shoulder 78 so that, when the desired crimper penetration is achieved, any further movement of the piston 16 will unseat the transfer check valve 70 and relieve fluid from the piston 14 back to the transfer chamber 60.

Figure 2:
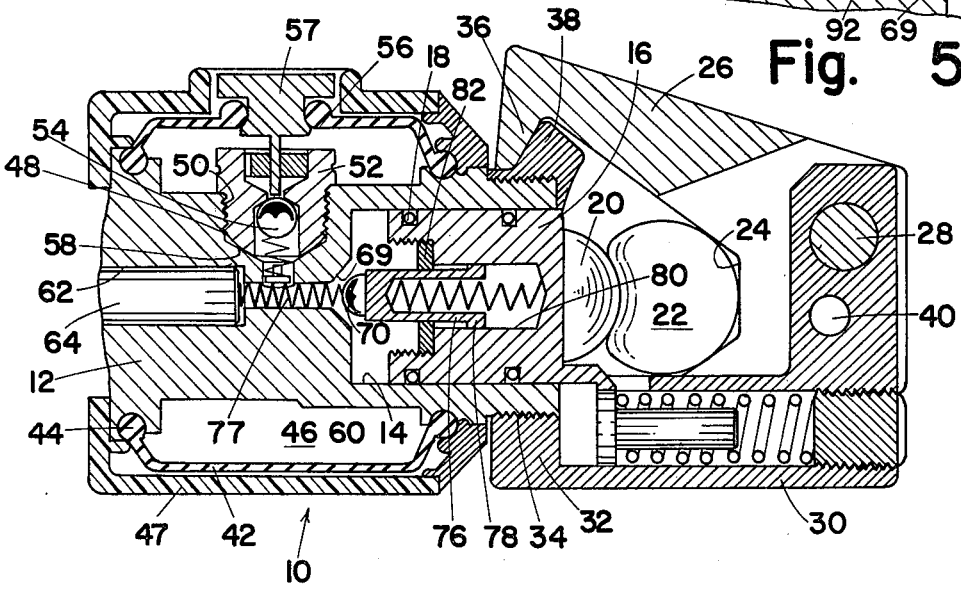
FIGS. 2, 3 and 4 are partial section views of the tool in various stages of operation.

Referring now to FIGS. 1 to 4 in sequence, FIG. 1 shows the tool with the lever 65 drawn back and the plunger 64 retracted. This allows flow from the reservoir 46, past the inlet check valve 54, to fill the transfer chamber 60 as well as the small bore 62. Then, as shown in FIG. 2 the plunger 64 is brought forward so that the fluid pressure, augmented by the spring 77, drives the transfer check valve 70 off its seat and forces the piston 16 forward through an increment of movement. Of course, during this movement, the inlet check valve 54 is tightly seated.

Figure 3:
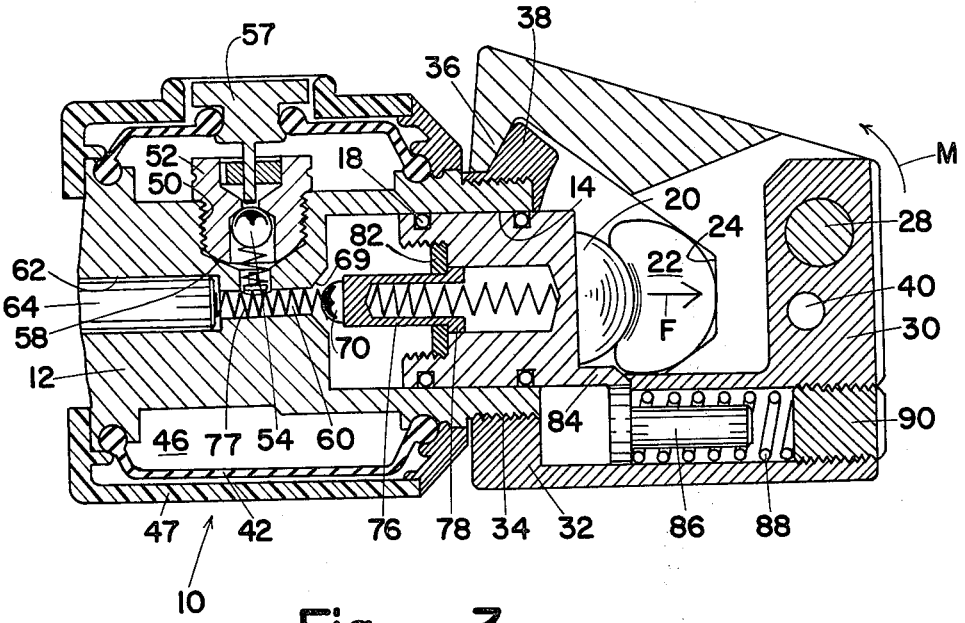
Figure 4:
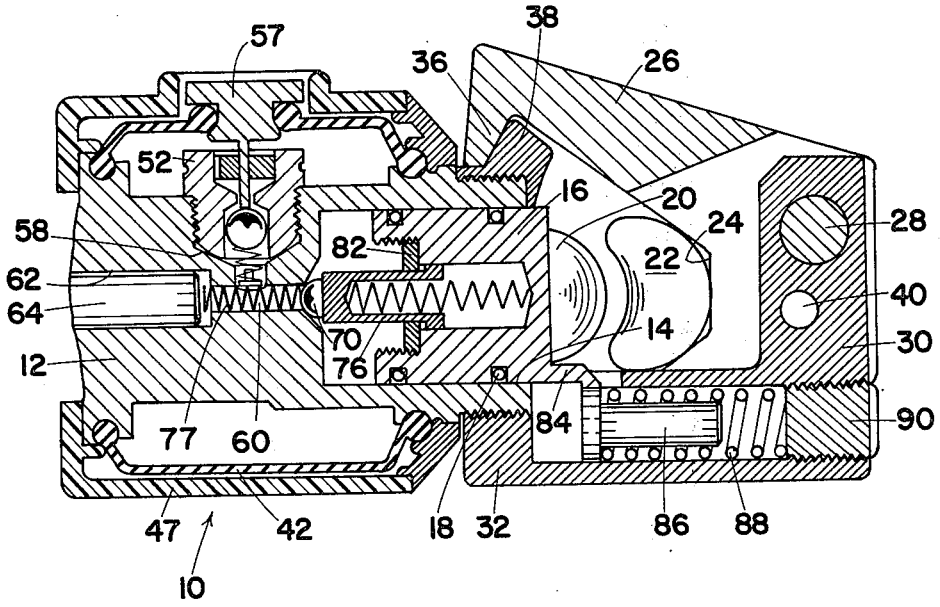

This operation is repeated until the spring 77 is ineffective against the fluid pressure. Thereafter, as shown in FIG. 3, the threaded collar 82 engages the shoulder 78 on the small piston 76 and lifts the transfer check ball 70 from its seat 69 and allows reverse flow back to the transfer chamber 60. This sudden release of pressure is felt at the hand of the operator, who then knows that the crimping stroke has been completed. This also relieves pressure enough to reduce considerably the force biasing the transfer inlet ball check 70 and enables the spring 77 to hold it from its seat while the operator depresses the button 57 with his hand to force the ball check 54 from its seat, thus relieving the piston 14 completely.

An arm 84 with spring retainer 86 carried thereon is biased by a spring 88 which may be adjusted by a threaded plug 90 carried on the stationary jaw member 30. Consequently, with pressure in the chamber 16 relieved, the spring 88 can force the piston back to the initial point of its stroke.

Figure 5:
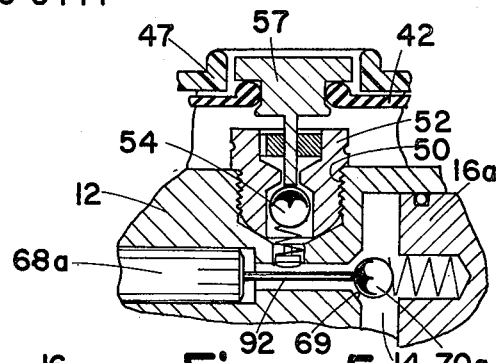
FIG. 5 is a partial section view of another embodiment.

The Embodiment of FIG. 5

In this embodiment the transfer ball check **70*a* is lifted from its seat 69 selectively at any stage of the operation. For this purpose a pin 92 carried on the end of a plunger 68*a* unseats a spring-biased transfer check valve 70*a* at the end of its stroke. Of course, the ball 70*a* is unseated during each stroke in any event. However, when the operator has driven the piston 16*a* as far forward as he wishes for whatever work he is doing he simply continues to squeeze the handles 65 and 66 to hold the ball unseated and then reaches forward to depress the button 57, unseating the ball 54 and exhausting the cylinder 14**.

While this invention has been described in conjunction with a preferred embodiment thereof, it is obvious that modifications and changes therein may be made to those skilled in the art without departing from the spirit and scope of this invention, as defined by the claims appended hereto.

What is claimed as invention is:

1. A hydraulic force delivering tool comprising:
- a cylinder having an open end;
- a piston slidable in said cylinder;
- a force-applying member on one of said piston and cylinder;
- a flow port opening into said cylinder;
- a transfer check valve engaging said port to enable flow into said cylinder only;
- a fluid transfer chamber in communication with said flow port;
- pump means for forcing fluid from said transfer chamber past said check valve; and
- mutually engagable means on said piston and said transfer check valve for lifting said transfer check valve from said port when said piston has traveled through a predetermined stroke.

2. The force delivering tool defined by claim 1 including:
- a small bore extending into said piston from the trailing end thereof;
- a spring-biased carrier for said transfer check valve slidable in said bore; and
- an internal shoulder in said bore and an external shoulder on said carrier forming said mutually engagable means.

3. The force delivering tool defined by claim 1 wherein:
- said force applying means is on said piston, and including:
- work piece gripping means carried on said cylinder; and
- an anvil surface on said gripping means opposed to said force-applying member.

4. The force delivering tool defined by claim 3 wherein said force-applying member comprises:
- a nodular mass on the crown of said piston.

5. The force delivering tool defined by claim 4 wherein said gripping means comprises:
- a stationary hinge member extending from one side of said cylinder; and
- a movable hinge member pivoted to said stationary member to extend back to the other side of the cylinder and embrace a work piece;
- the hinge axis being offset toward said other side of the cylinder so that a force applied by said nodular mass biases said movable hinge member toward said other side of the cylinder.

6. The force delivering tool defined by claim 1 including:
- a reservoir around said transfer fluid chamber;
- a relief chamber in connumication with said cylinder;
- an inlet-relief port between said transfer chamber and said reservoir;
- a relief check valve normally enabling flow through said relief port from said reservoir only; and
- a manually and selectively operable push member to unseat said relief check valve.

7. The force delivering tool defined by claim 6 wherein:
- said mutually engagable means lift said transfer check valve from said flow port to return a charge of fluid to said fluid transfer chamber and reduce pressure in said cylinder and transfer chamber enough to enable manual operation of said push member.

8. A hydraulic force delivering tool comprising:
- a cylinder having an open end;
- a piston slidable in said cylinder;
- a force-applying member on one of said piston and cylinder;
- a flow port opening into said cylinder;
- a transfer check valve engaging said port to enable flow into said cylinder only;
- a fluid transfer chamber in communication with said flow port;
- a plunger for forcing fluid from said transfer chamber past said transfer check valve; and
- means on the plunger engagable with said transfer check valve to lift same from said port in the end of the stroke of said plunger.

9. The force delivering tool defined by claim 8 including:

a reservoir around said transfer fluid chamber;

a relief chamber in communication with said cylinder;

an inlet-relief port between said transfer chamber and said reservoir;

a relief check valve normally enabling flow through said relief port from said reservoir only; and a manually and selectively operable push member to unseat said relief check valve.

10. A hydraulic tool comprising:

a cylinder;

a piston slidable in said cylinder;

a reservoir;

a flow passageway connecting said reservoir and said cylinder;

first and second valve seats surrounding said flow passageway at said reservoir and said cyinder, respectively;

first and second check valves engaging said valve seats, each to enable flow in one direction only from said reservoir to said cylinder;

a bore opening into said flow passageway intermediate said valve seats;

a plunger reciprocable in said bore so that when retracted it draws a charge of fluid from said reservoir past said first check valve, and when extended it forces said charge of fluid past said second check valve into said cylinder; and first and secod positive contacting disengaging means for unyieldingly engaging and forcing said first and second check valves, respectively, from their seats irrespective of the direction of fluid pressure drop thereacross.

11. The hydraulic tool defined by claim 10 wherein said second disengaging means comprises:

mutually engagable means on said piston and said second check valve for lifting said second check valve from said second valve seat when said piston has traveled through a predetermined stroke.

12. The hydraulic tool defined by claim 11 including:

a small bore extending into said piston from the trailing end thereof;

a spring-biased carrier for said second check valve slidable in said bore; and an internal shoulder in said bore and an external shoulder on said carrier forming said mutually engagable means.

* * * * *